US011454015B2

(12) United States Patent
Earnest

(10) Patent No.: US 11,454,015 B2
(45) Date of Patent: Sep. 27, 2022

(54) DETECTION PLATE AND KIT

(71) Applicant: Brett Earnest, Longview, WA (US)

(72) Inventor: Brett Earnest, Longview, WA (US)

( * ) Notice: Subject to any disclaimer, the term of this patent is extended or adjusted under 35 U.S.C. 154(b) by 0 days.

(21) Appl. No.: 17/110,181

(22) Filed: Dec. 2, 2020

(65) Prior Publication Data

US 2021/0164213 A1 Jun. 3, 2021

Related U.S. Application Data

(60) Provisional application No. 62/942,352, filed on Dec. 2, 2019.

(51) Int. Cl.
*E03D 11/16* (2006.01)
*G08B 21/20* (2006.01)

(52) U.S. Cl.
CPC ..... *E03D 11/16* (2013.01); *G08B 21/20* (2013.01)

(58) Field of Classification Search
CPC ..... E03D 11/16; G08B 21/20
See application file for complete search history.

(56) References Cited

U.S. PATENT DOCUMENTS 4,233,697 A * 11/1980 Cornwall ..... E03D 11/16 138/89
5,461,904 A * 10/1995 Baker ..... G01M 3/2853 277/320
10,032,355 B2 7/2018 Tilley
2011/0209278 A1* 9/2011 Hatt ..... E03D 11/16 4/252.5
2018/0180508 A1* 6/2018 Ghodrati ..... E03D 11/16
2019/0085547 A1* 3/2019 Valedez Magana ... F16J 15/064

* cited by examiner

*Primary Examiner* — Janie M Loeppke
(74) *Attorney, Agent, or Firm* — Dean A. Craine, P.S.

(57) ABSTRACT

A water leak detection plate is placed between the toilet flange plate attached to a subfloor and a toilet base with a wax seal disposed between them. The detection plate includes a circular disc body with a wastewater hole axially aligned with the wastewater hole formed on the toilet flange plate. Surrounding the wastewater hole is an outer flange area with a perimeter edge. Formed on the outer flange area are two bolt holes aligned with two bolts attached to the toilet flange plate used to attach the toilet base to the toilet flange plate. Formed or attached to the disc body's perimeter edge is a continuous, upward extending gutter configured to collect water leaking from the wax seal or the toilet base. Also formed on the bottom surface of the disc body is an upward extending recessed cavity in which the toilet flange plate rests. The detection plate may be used with an external water detection device placed in the gutter.

9 Claims, 8 Drawing Sheets

DETECTION PLATE AND KIT

This utility patent application is based on and claims the filing date benefit of U.S. provisional patent application (application Ser. No. 62/942,353) filed on Dec. 2, 2019.

Notice is given that the following patent document contains original material subject to copyright protection. The copyright owner has no objection to the facsimile or digital download reproduction of all or part of the patent document, but otherwise reserves all copyrights.

BACKGROUND OF THE INVENTION

1. Field of the Invention

This invention pertains to devices used to attach a toilet base to the subfloor and also configured to be used with water detecting components that detect water leaking under the toilet base.

2. Description of the Related Art

The current International Plumbing Code and the Uniform Plumbing Code both require that joints formed where fixtures come in contact with walls and floors shall be sealed or water-tight. Because toilets are fixtures, they must be sealed and water-tight to the floor.

Many plumbers consider the wax ring or wax seal used between a toilet base and the toilet flange plate attached to the subfloor to form a water-tight seal and meets these code requirements. To these plumbers, caulking the joint between the toilet base and the floor is unnecessary. Many home inspectors disagree.

Wax rings or wax seals are usually sufficiently thick and malleable to form a water-tight seal between the toilet base and the toilet flange plate (also called a 'closet flange') when the toilet base is set correctly and tightened to the toilet flange plate. If the toilet base is not set correctly over the toilet flange plate or if the toilet base moves after installation, wastewater may leak between the wax ring and the toilet flange causing damage to the subfloor. Because area of the subfloor under the toilet plate flange is hidden, water leaking can go undetected for months and years.

What is needed is a water leak detection plate that can be used with a standardized toilet that uses a malleable wax ring or wax seal that presses against a toilet flange plate and can also be used to detect water leaks under the toilet base.

SUMMARY OF THE INVENTION

Disclosed herein is a water leak detection plate configured to be placed between the toilet flange plate attached to the subfloor and the wax ring or wax seal placed under the toilet base. The water leak detection plate, hereinafter called a 'detection plate', includes a flat, circular disc body with an axially aligned wastewater hole approximately the same diameter as the wastewater hole formed on a standardized, 7 inch diameter toilet flange plate. During use, the toilet flange plate is attached to the subfloor and detection plate is aligned over the toilet flange plate so that the wastewater holes are axially aligned.

The outer flange area of the disc body surrounding the wastewater hole is flat or slightly beveled outward. Formed on opposite sides of the outer flange area are two bolt holes aligned with two bolts attached to and extend upward from the toilet flange plate. The two bolts attach the toilet base to the toilet flange plate. Formed or attached to the outer flange area's perimeter edge is a pendent, upward extending gutter configured to collect water deposited on the outer flange area, ef dripping from the wax seal, or dripping from the toilet base.

Formed on the bottom surface of the disc body is an upward extending recessed cavity. The recessed cavity has a diameter sufficient to receive the toilet flange plate when attached to the subfloor. Formed on the outer walls of the recessed cavity (also the inner wall of the gutter) is a plurality of side slots that communicate with the gutter enabling water located in the recessed cavity to seep laterally and enter the gutter.

The detection plate may be used alone or with other water detection components to form a kit that informs the homeowner that water is present under the toilet base. In one embodiment, the detection plate is used with a wick placed in the gutter that changes color when wet. At least one end of the wick extends through an elongated slot formed on the outer flange area of the disc body. The wick then bends upward from the elongated slot. When attaching a toilet base to the toilet flange plate, a wax ring is first placed over the top surface of the toilet flange plate. The end of the wick extends upward from the disc body passes through a bolt hole formed on the toilet base. In one embodiment, the end of the wick terminates in a bolt cap that is positioned over the end of the bolt and nut that holds the toilet base to the toilet flange plate. In one embodiment, the opposite ends of a single wick extend through bolt holes formed opposite sides of the toilet base and into the gutter. The bolt cap forms a water-tight seal around the wick that prevents water coming in contact with the end of the wick. In one embodiment, the bolt cap may include a viewing window that enables a homeowner to view the end of the wick extending through the toilet base 4*e* to determine if water is present under the toilet base.

In a second embodiment of the water detection kit, the wick is replaced with a cable with at least two contacts placed in the gutter. When water is present in the gutter, a ground fault condition occurs which creates a signal that is delivered to a signal receiving device mounted in the bolt cap located on the toilet base. The signal receiving device may be a light, a speaker or a network transmitter configured to transmit the signal to a remote receiver.

DESCRIPTION OF THE PREFERRED EMBODIMENT(S)

Figure 1:
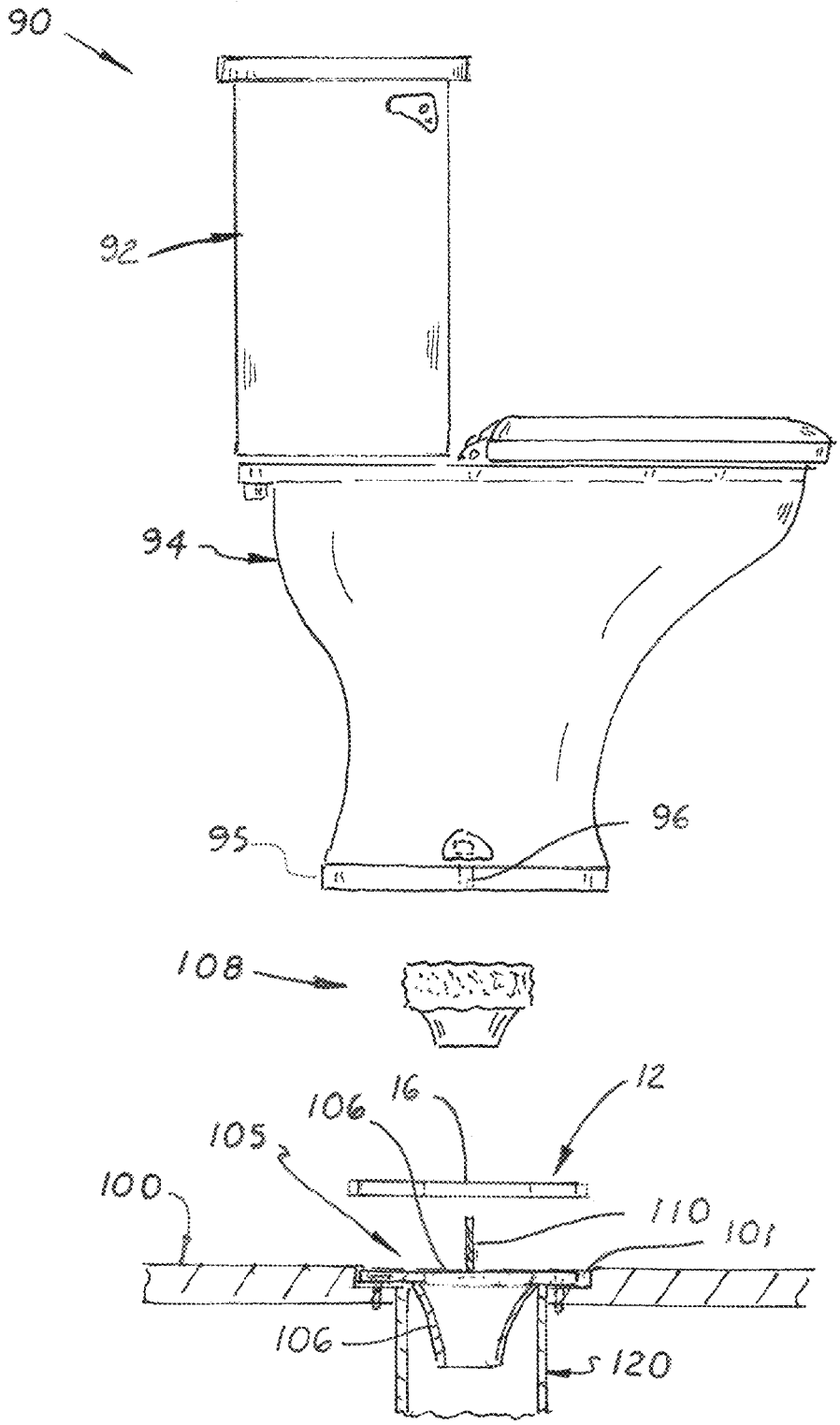
FIG. 1 is an exploded, side elevational view of a toilet showing the toilet base mounted over a wax ring, a water detection plate placed under the wax ring, and toilet flange plate under the water detection plate and mounted to the subfloor and over a main waste-water pipe.

Disclosed herein is a detection plate 12 configured to be used with a standard toilet 90 that includes a water tank 92 mounted on a toilet base 94. As shown in FIG. 1, formed on the toilet base 94 is a lower toilet flange 95 with two side holes 96 that receive two threaded bolts 110 that extend upward from the opposite sides of a toilet flange plate 105 mounted on the subfloor 100. A main wastewater pipe 120 extends upward through the subfloor 100.

Figure 4:
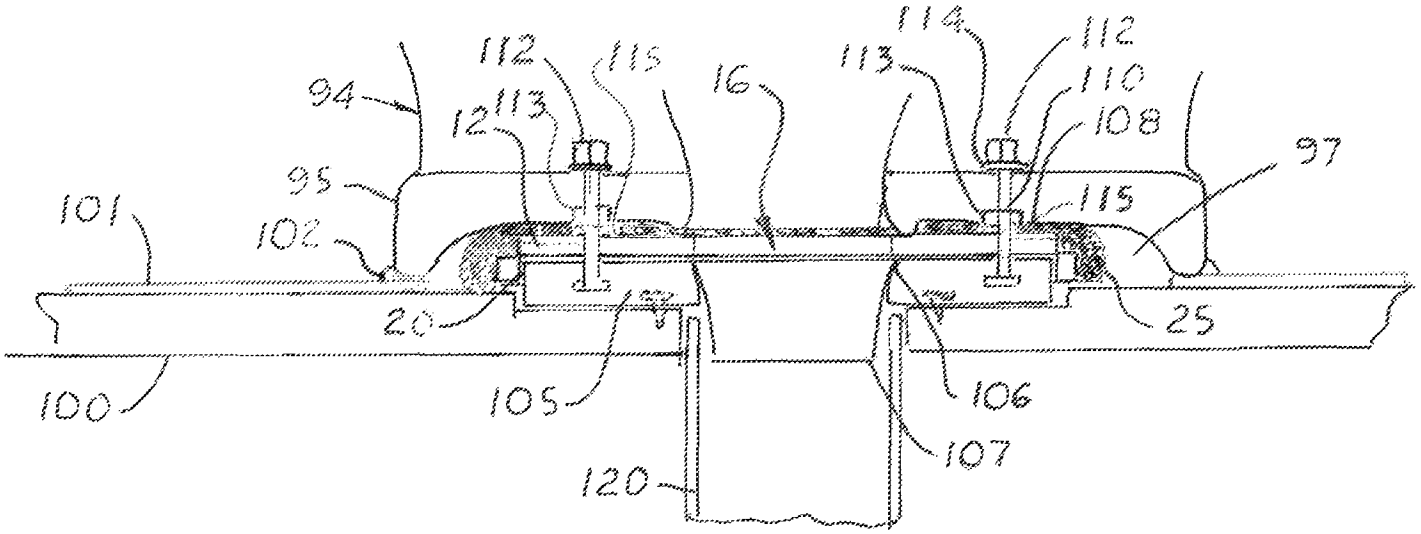
FIG. 4 is a sectional side elevational view of toilet mounted over wax ring, the water detection plate located under the wax ring, the toilet flange plate located under the water detection plate and mounted in a recessed cavity formed on the subfloor.

The toilet flange plate 105, shown more clearly in FIG. 4 is a circular plate structure with a coaxially aligned wastewater hole 106 and a downward extending, conical adapter 107. The toilet flange plate 105 is securely attached to the subfloor 100 with suitable connectors. During construction, the conical adapter 107 fits into the end of the main wastewater pipe 120. In most instances, the toilet flat plate 105 fits into recessed circular cavity 101 formed in the subfloor 100 so that the top surface of the toilet flange plate 105 is substantially even or flush with the top surface of the subfloor 100.

Figure 6:
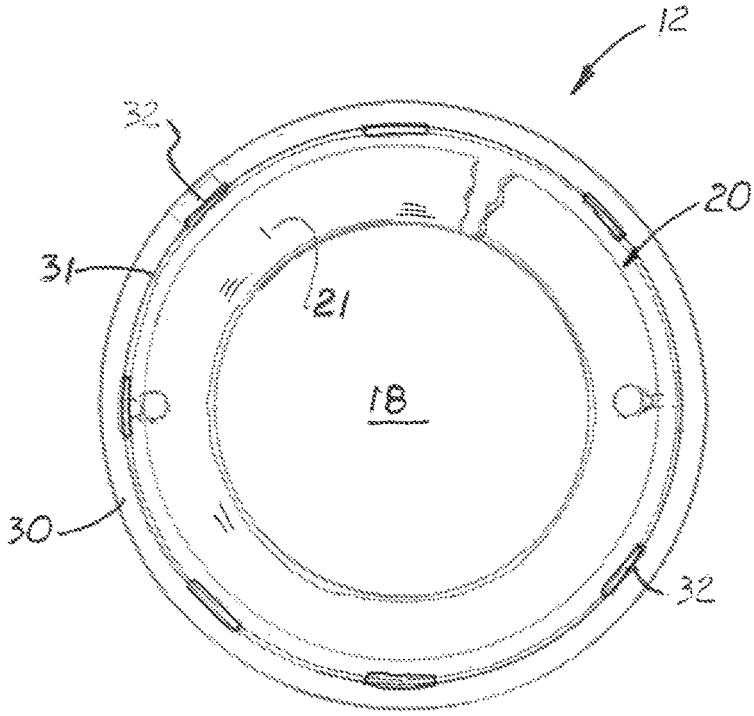
FIG. 6 is a bottom plan view of the water detection plate showing the cavity formed on the bottom surface of the disc body and showing an optional gasket attached to the inside surface of the disc body.

Positioned above the toilet flange plate 105 is the detection plate 12 that includes a flat, circular disc body 14 with an axially aligned wastewater hole 16. Disc body is approximately the same diameter as the toilet flange plate 105 and the wastewater hole 16 is approximately the same diameter as the top opening formed on the conical adapter 107. The wastewater hole 16 is smaller in diameter than the disc body 15 thereby forming a flat, outer flange area 18 that surrounds the wastewater hole 16. The outer flange area 18 includes a circular perimeter edge 19. Formed along the perimeter edge 19 is a downward extending gutter 25. The gutter 25 includes an inner side wall, a top opening and a closed bottom surface. The bottom surface is located below the outer flange area 18 thereby creating a collection slot for water dripping onto the outer flange area 18. Formed on the inside, vertical inner side wall of the gutter 25 is a plurality of elongated opening 31 (shown more clearly in FIGS. 6 and 8).

Formed on the bottom of the disc body 14 and surrounded by the gutter 25 is an upward extending cylindrical cavity 20. The cavity 20 is coaxially aligned with the wastewater hole 16 and slightly larger than the toilet flange plate 105 so that the toilet flange plate 105 may partially extend into the cavity 20. When the disc body 14 is placed around the toilet flange plate 105, the top surface of the disc body 14 is even or slightly higher than subfloor 100. When flooring 101 is attached to the subfloor 100, the disc body 14 fits into a recessed cavity 97 formed on the bottom surface of the toilet flange 95.

Formed on opposite sides of the outer flange area 18 of the disc body 14 are two bolt holes 22 that are aligned with two bolts 110 attached to and extend upward from the toilet flange plate 105. The two bolts 110 are used to attach the toilet base 94 to the toilet flange plate 105. Attached to the inside surface of the outer flange area 18 is a flat ring-shaped gasket 21 made of rubber or silicone. A suitable adhesive may be used to attach the gasket 21 to the inside surface of the outer flange area 18.

Figure 7:
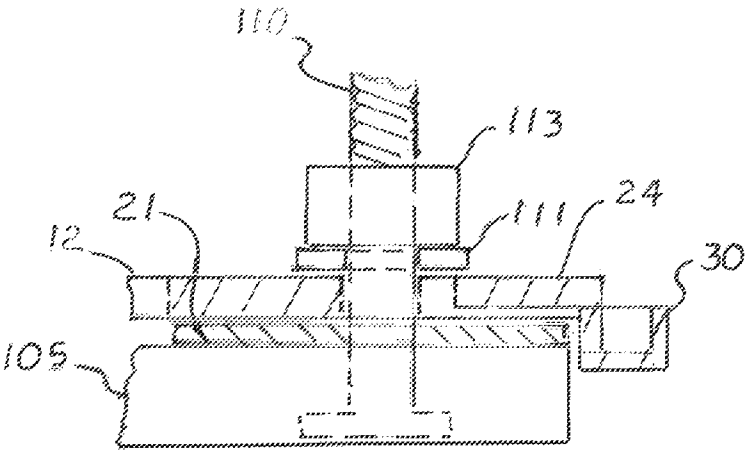
FIG. 7 is a partial sectional, elevational view showing the water detection plate mounted over the toilet flange plate with a threaded bolt extending upward from the toilet flange plate and through the disc body with an optional slotted washer and nut attached to the section of the bolt adjacent to the disc body which, when tightened, securely attaches the disc body to the toilet flange plate.
Figure 9:
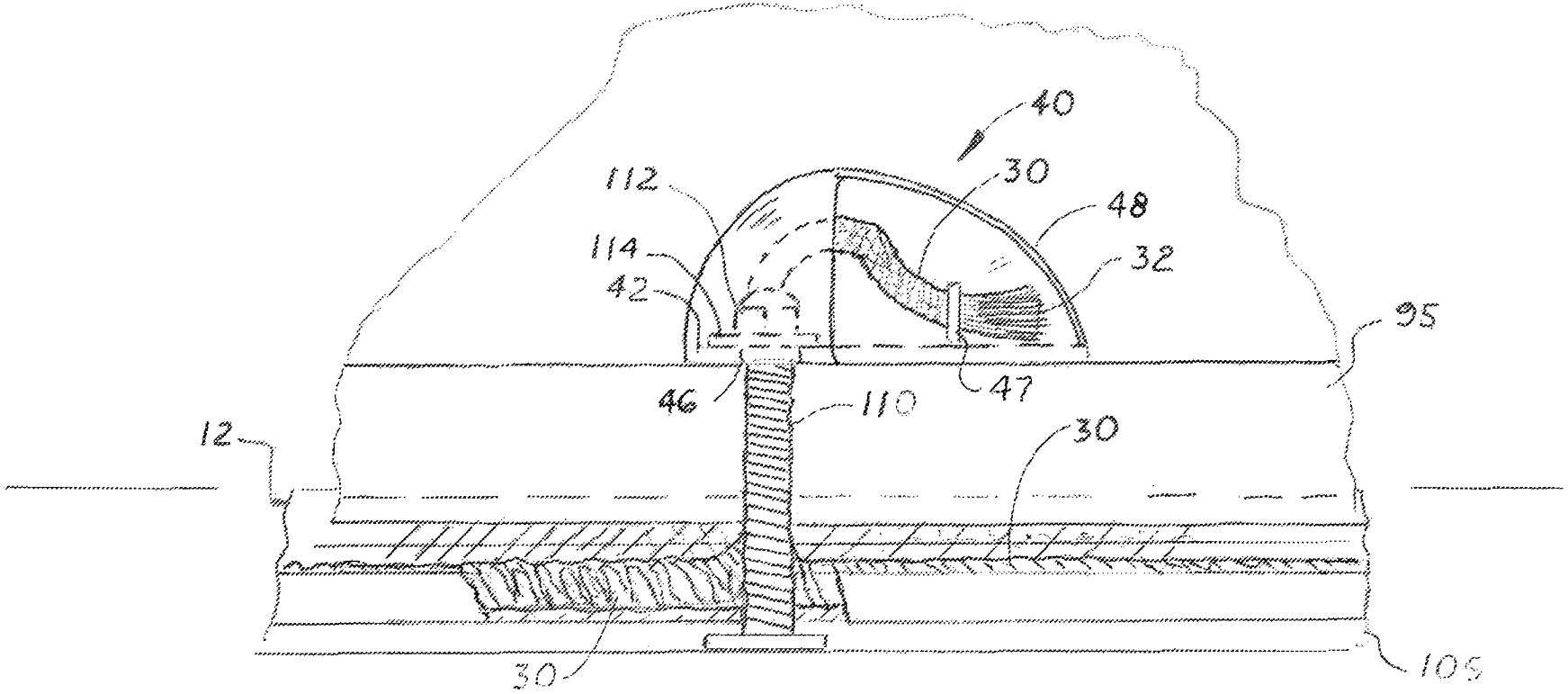
FIG. 9 is a partial, sectional side elevation view of a toilet placed over the bolt extending upward from the toilet flange plate through the water detection plate, also shown is a wick located in the gutter that extends upward through the disc body, and through the bolt hole formed on the toilet base, and showing the base cap assembly with a viewing window positioned over the end of the bolt extending through the toilet base and the end of the wick being visible through the window.
Figure 11:
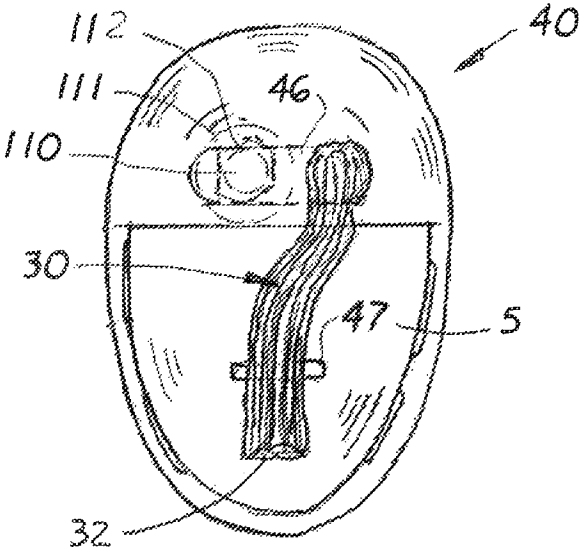
FIG. 11 is a top plan view of the base cap assembly.
Figure 10:
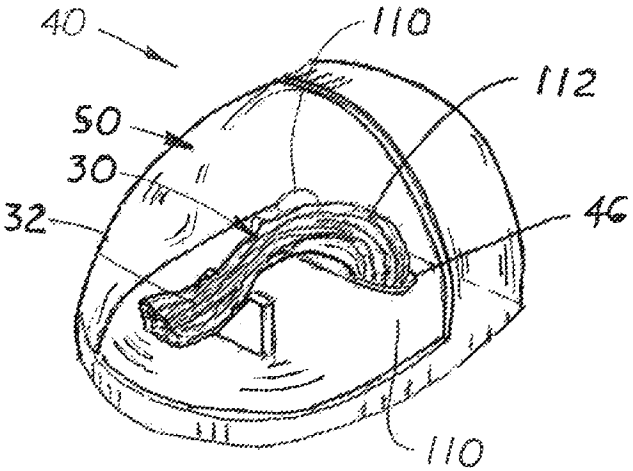
FIG. 10 is a top perspective view of the base cap assembly with the end of the wick visible through the window.

FIG. 7 shows the water detection plate 12 mounted over the toilet flange plate 105 with a threaded bolt 110 extending upward from the toilet flange plate 105 and through the detection plate 12 with a slotted washer 111 and nut 113 attached to the section of the bolt 110 adjacent to the detection plate 12. When the nut 113 is tightened on the bolt 110, the detection plate 12 is securely fastened to the toilet flange plate 105.

As shown in FIGS. 2-6 and 8, also formed on the outer flange area 18 are two elongated slots 24 that extend inward from the gutter 25 towards the bolt hole 22. The elongated slots 24 may be used with water detecting, such a hydrochronic wick or a ground detecting cable, discussed further below The detection plate 12 is configured to be used under a wax ring 108. During use, a wax ring 108 may be placed directly over the detection plate 12 after it has been positioned over the toilet flange plate 105. Alternatively, the wax ring 108 may be forced against the inside surface of the recessed cavity 97 formed on the toilet base 94. The toilet base 94 is then lowered over the detection plate 12. Nuts 113 and washers 111 are then attached to the bolts 110 which presses the toilet base 94 against the wax ring 108 causing wax to spread outward over the detection plate 12 and create a watertight seal. Caulking 102 may be applied to the joint between toilet base 94 and floor 101.

In the embodiment shown in the FIGS, the disc body 12 is made of metal or ABS plastic and measures approximately 7.75 inches in diameter. The wastewater hole 16 is approximately 4.5 inches in diameter. And the outer flange area 18 is approximate 1.5 inches wide. The gutter 25 is approximately ¼ inch wide and 0.38 high. The disc body 14 is approximately 0.38 inches thick and the cavity 20 is approximately 0.38 inches deep.

In the embodiment shown in the FIGS, the disc body 14 is made of metal or ABS plastic and measures approximately 7.75 inches in diameter. The wastewater hole 16 is approximately 4.5 inches in diameter. And the outer flange area 18 is approximate 1.5 inches wide. The gutter 25 is approximately ¼ inch wide and 0.38 high. The disc body 14 is approximately 0.38 inches thick and the cavity 20 is approximately 0.38 inches deep.

The detection plate 12 may be used with one or two external water detection systems also disclosed herein. In one embodiment, the external water detection system includes a wick 30 placed in the gutter 25 that changes color when wet. At least one end of the wick 30 extends inward through the elongated slot 24 formed on the disc body 14. The wick 30 then extends upward through a bolt hole 96 formed on the toilet flange 95. During assembly, the end of the wick 30 extends beyond the toilet flange 95 and terminates inside a bolt cap assembly 40 that sits over the end of the bolt 110 extending through the toilet flange 95. In one embodiment, the bolt cap assembly 40 includes a lower plate 42 and a removable lid 48. The lid 48 snap fits onto the lower plate 42 thereby forming a watertight seal. The lid 48 may include a viewing window 49 that enables a homeowner to view the end of the wick 30 extending through the toilet flange 95 to determine if water is present under the toilet base.

Formed on the lower plate 42 is a transversely aligned elongated slot 46. During assembly, the end of bolt 110 extends through a bolt hole 95 formed on the toilet base 94. The lower plate 42 is aligned over the top surface of the toilet base 94 so that the end of the bolt 110 and the wick 30 extends through the elongated slot 46. A slotted washer 111 is placed around the end of the bolt 110 and a nut 112 are then attached to the end of the bolt 110 and tightened to securely attach the lower plate 42 to the toilet base 94. The wick 30 is extended through slot 46 and bent forward and connected to a wick holder 47 attached to the lower plate 42.

Figure 2:
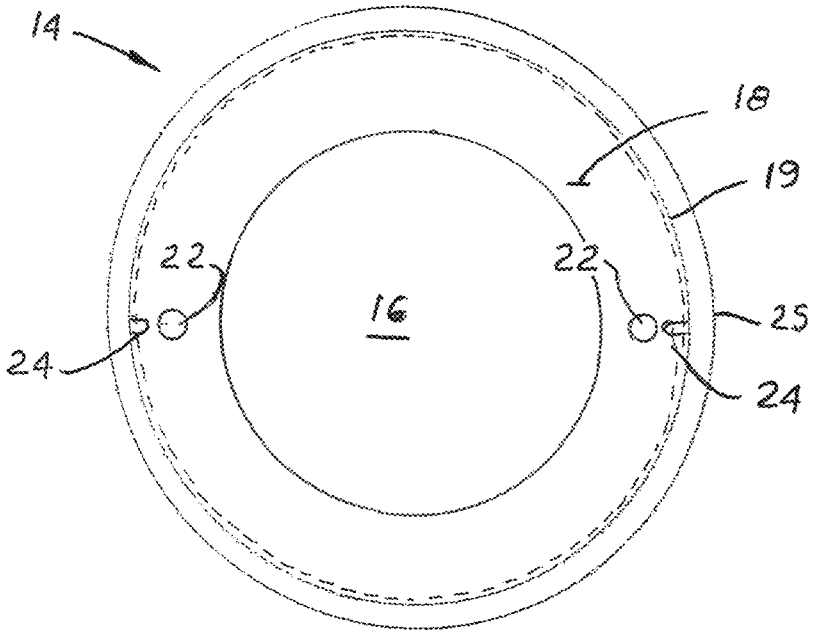
FIG. 2 is a top plan view of the water detection plate.
Figure 3:
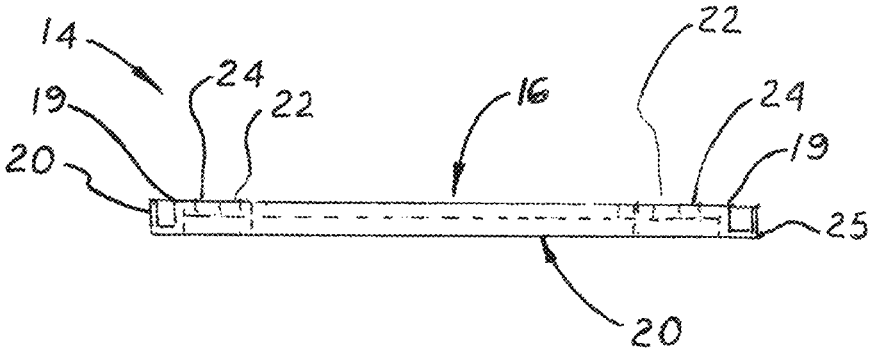
FIG. 3 is a side elevation view of the water detection plate shown in FIG. 2.
Figure 5:
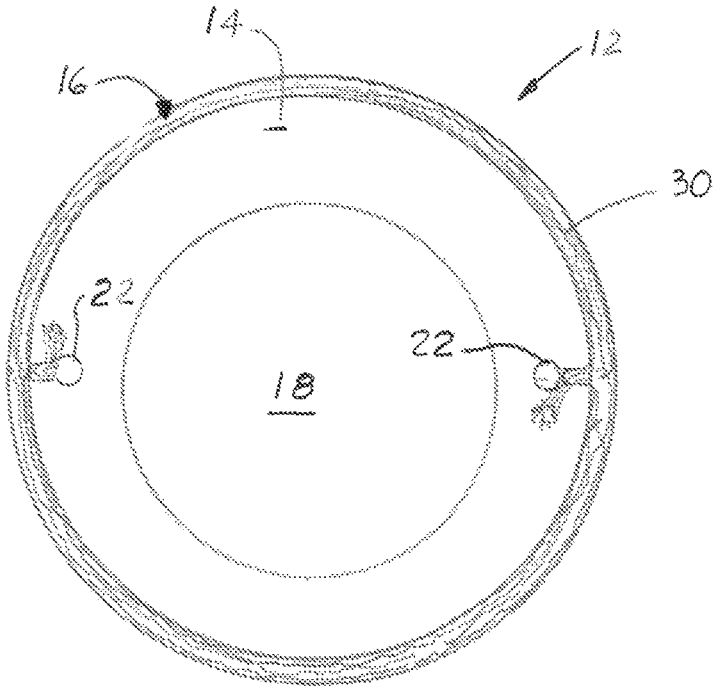
FIG. 5 is a top plan view of the water detection plate shown in FIG. 3 with a water indicating wick placed inside the gutter and then extended into a lateral slot form on the disc plate.
Figure 12:
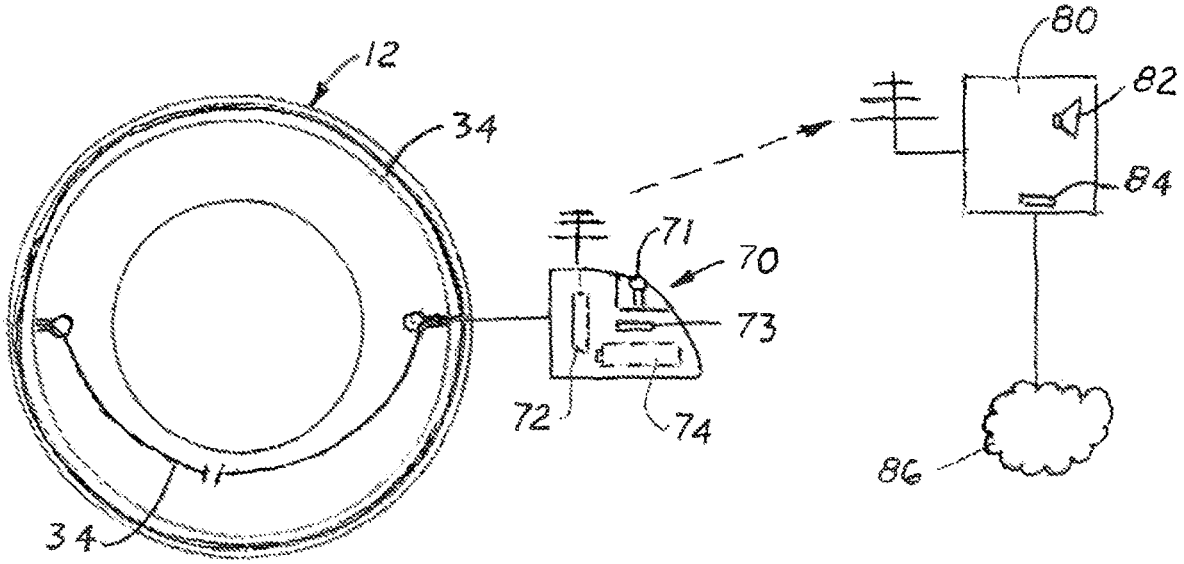
FIG. 12 is an illustration of another embodiment of the system that uses a cable in the groove formed on the base in place of a wick used in the first embodiment, the cable includes two wires used to detect a short condition that activates a lightbulb or a transmitter.

As shown in FIGS. 2, 5, and 12, the gutter 25 is a continuous curved slot designed to collect water that drips onto the outer flange area 18. If water seeps laterally under the disc body 16, it can flow into the gutter through the elongated opening 31 formed on inside wall of the gutter 25. The gutter 25 is also configured to retain a single elongated wick 30 when placed inside the gutter 25. The opposite ends of the wick 30 extend through the elongated slot 24 formed on the outer flange area 18. It should be understood that gutter 25 may only partially extend around the perimeter edge of the disc body 14 and that two or more wicks 30 may be placed inside the gutter 25.

Figure 8:
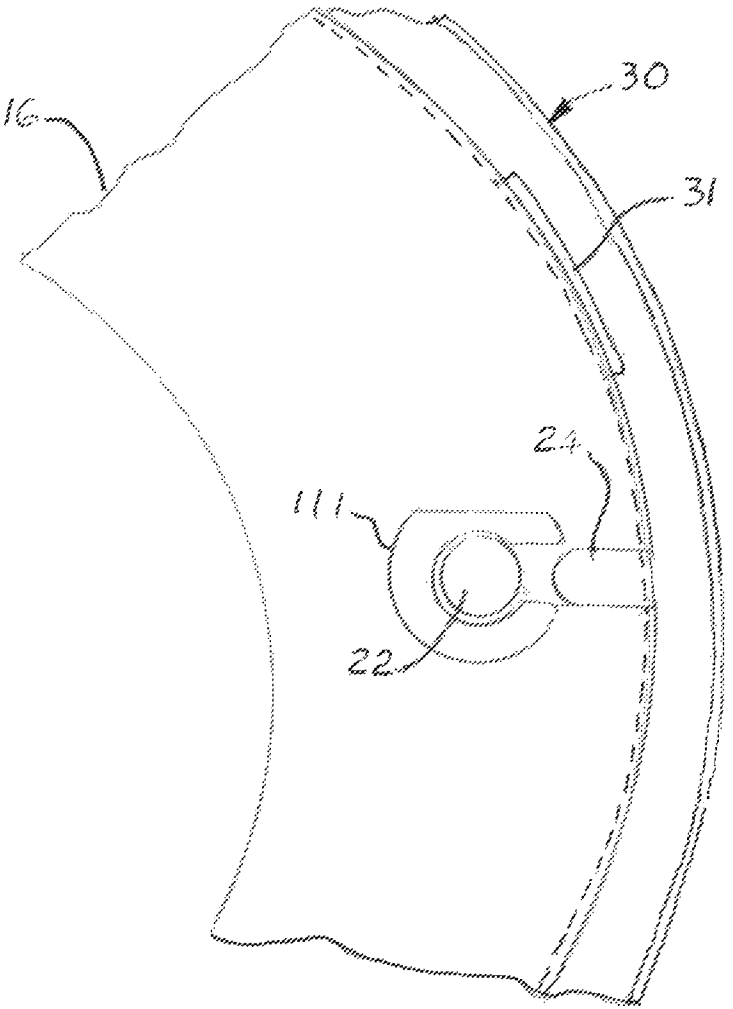
FIG. 8 is a partial top plan view of the disc body showing the slotted washer aligned over a bolt hole formed on the disc body and the lateral slot formed on the slotted washer being aligned with the elongated slot that extends to the gutter.

In the embodiment shown herein, a rubber, silicone or foam gasket 21 may be attached to the bottom surface of the disc body 14 as shown in FIG. 8, that presses against the toilet flange plate 105 to create a watertight seal between the disc body 14 and the toilet flange plate 105. Creation of a watertight seal between the disc body 14 and the toilet flange plate 105 may be needed to prevent contact with the wick 30 when the main wastewater line is backflushed.

The wick 30 is coated with a hydrochromic dye that changes color when wet exposed to moisture. Such dyes are commonly used with infant diapers. The lid 48 includes a transparent window 50 that always allows the user to view the color of the wick 30.

During assembly, the wick 30 is placed in the gutter 25 and extended through the two elongated slots 24. The disc body 14 is oriented so the cavity 20 faces downward, The disc body 14 is then placed over the toilet flange plate 105 mounted on a recessed surface formed on the subfloor 100. An optional gasket 21 may be attached to the bottom surface of the outer flange area 18. Slotted washer 111 and nut 113 may be attached to bolt 110 to securely attach the disc body 14 to the toilet flange plate 105. The wax ring 60 may then be positioned over the disc body 14 or attached to the top surface of the toilet recessed cavity 97. The toilet base 94 are then lifted and positioned so that the wastewater opening on the wax ring 60 is aligned with the wastewater drain hole 18 formed on the disc body 14 and with the wastewater hole (not shown) used on the toilet flange plate 105. When forced downward, the layer of wax 15 is squeezed laterally over the disc body 14 and partially over the gutter 25.

The upper end of the bolts 110 are then extended into the bolt holes 96 formed on the toilet flange 95. The toilet base 94 is then forced downward to force the wax ring 60 against and spread over the top surface of the disc body 12. The lower plate 42 on the base cap assembly 40 is then aligned over the bolt 110 and the wick 30 so that the bolt and wick 30 extend upward through the elongated slot 46. A second slotted washer 111, shown in FIG. 8, may be placed around the bolt 110. A second nut 112 is then attached to the end of the bolt 110 and tightened to securely attached the lower plate 42 to the toilet base 94. The wick 30 is bent forward and connects to the wick holder 47. The end 32 of the wick 30 may be flared making it more visible. The lid 48 is then attached to the lower plate 42.

In the embodiment presented herein the wick 30 is white when dry. When exposed to moisture, the wick 30 turns red.

Figure 13:
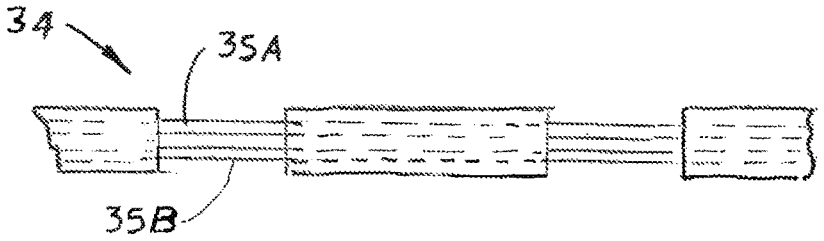
FIG. 13 is a partial, enlarged view of the cable shown in FIG. 12.

In a second embodiment shown in FIGS. 12 and 13, the wick 30 is replaced by a cable 34 that extends inside the gutter 25, extends inward across the disc body 14 and into the toilet base 94. The cable 34 includes two wires, 35A, 35B that when grounded by a drop of water creates a short condition. The cable 34 may be connected to a lightbulb 71 located inside the base cap assembly 70. Located inside the base cap is a battery configured to illuminate the light when a short condition exists.

In another embodiment, the base cap assembly 70 may include a transmitter 72 used in place of the lightbulb 71. The transmitter 72 is configured to connect to generate a wireless signal when a short condition from the cable 34 is detected. The transmitter 72 produces a wireless signal configured to be received by a compatible remote located receiver 80, such as a mobile phone with a software app configured to receive and process the wireless signal. The software app then produces a warning to the user that a leak has been detected. The base cap assembly 70 may also include a built-in speaker 82 and produces audio sound when a short condition is detected. The base cap assembly 70 may also include a wireless network adapter 84 configured to via WIFI signal received by a WIFI receiver.

FIG. 13 is a partial, enlarged view of cable 34 that includes two wires 35A, 35B with contacts or exposed sections that come in contact with water deposited in the gutter 25 to produce a short ground condition.

In compliance with the statute, the invention described has been described in language more or less specific as to structural features. It should be understood however, that the invention is not limited to the specific features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

I claim:

1. A toilet base water leak detection kit to be used with a toilet flange plate mounting on a recessed cavity on a subfloor, said toilet flange plate includes a wastewater hole and two upward extending toilet mounting bolts and mounted on subfloor, said detection kit, comprising;

a. a detection plate that includes a circular disc body with a coaxially aligned wastewater bole, an outer flange surface and a pendent, continuous gutter surrounding said outer flange surface, said gutter includes a continuous top opening and extends below said outer flange surface thereby forming a recessed circular cavity configured to receive the toilet flange plate when attached to said recessed cavity formed on said subfloor, said disc body includes least two bolt holes formed on said outer flange surface configured to receive said toilet mounting bolts:

b. a gasket placed inside said recessed circular cavity, said gasket includes a wastewater hole coaxially aligned and substantially the same diameter as said wastewater hole formed on said disc body:

c. two bolt cap assemblies, each said bolt can assembly includes a flat lower plate with a hole or slot configured to receive an end of said toilet mounting bolt when attaching a toilet base to said toilet flange plate; and d. a moisture detecting component that extends between said bolt cap assemblies, said moisture detecting component extends into said gutter, said moisture detecting component configured to detect water deposited in said gutter.

2. The toilet base water leak detection bit as recited in claim 1, wherein said moisture detecting component is at least one wick that extends from one said bolt cap assembly and into said gutter and changes color when exposed to water deposited into said gutter.

3. The toilet base water leak detection kit as recited in claim 1, further including a plurality of elongated openings formed on said gutter that enable water to seen laterally into said cutter.

4. The toilet base water leak detection kit as recited in claim 2, wherein said wick extends through a slot formed in said base cap assembly.

5. The toilet base water leak detection kit as recited in claim 1, further including a removable lid that selectively attaches to said flat lower plate, said removable lid includes a transparent window configured to allow a wick inside said base cap assembly to be viewed.

6. The toilet base water leak detection kit as recited m claim 1, wherein said moisture detecting component is a cable configured to detect a ground fault condition caused by water deposited in said gutter.

7. The toilet base water leak detection kit as recited in claim 6 wherein said cable is attached to a light source located inside at least one said bolt cap assembly illuminated when a round fault condition occurs.

8. The toilet base water leak detection kit as recited in claim 6, wherein said cable is attached to a speaker that produces an identifiable sound when a ground fault condition occurs.

9. The toilet base water leak detection kit as recited in claim 6, wherein said cable is attached to a network adapter configured to transmit said ground fault condition to a remote receiver.

* * * * *